United States Patent [19]

Emmons

[11] Patent Number: 4,743,215

[45] Date of Patent: May 10, 1988

[54] MULTI-USE DOLL PLAYHOUSE

[75] Inventor: Mickie C. Emmons, Indianapolis, Ind.

[73] Assignee: The Kamper Family, Inc., Indianapolis, Ind.

[21] Appl. No.: 879,251

[22] Filed: Jun. 27, 1986

[51] Int. Cl.[4] ..... A63H 3/52; A63H 33/30; E04H 15/58

[52] U.S. Cl. ..... 446/478; 446/486; 135/87; 135/117

[58] Field of Search ..... 446/478, 476, 479, 71, 446/73, 74, 75, 76, 79, 80, 486; 135/87, 93, 91, 117; 5/413, 414

[56] References Cited

U.S. PATENT DOCUMENTS

| | | | |
|---|---|---|---|
| 872,404 | 12/1907 | Burch | 5/413 X |
| 1,239,550 | 9/1917 | Wykert | 135/87 |
| 1,684,237 | 9/1928 | Marbury | 135/117 X |
| 2,078,809 | 4/1937 | Richman | 446/74 |
| 2,299,078 | 10/1942 | Craig et al. | 135/91 X |
| 2,543,684 | 2/1951 | Bianchard | 135/94 |
| 2,837,777 | 6/1958 | White | 446/478 X |
| 2,907,056 | 10/1959 | Kaplan | 135/87 X |
| 3,043,320 | 7/1962 | Moss | 135/93 |
| 3,244,186 | 4/1966 | Thomason et al. | 135/92 X |
| 3,601,825 | 8/1971 | Moorhead | 135/117 X |
| 3,699,986 | 10/1972 | Kirkham | 135/87 X |
| 4,067,137 | 1/1978 | Korthase | 446/478 |
| 4,072,158 | 2/1978 | O'Brien et al. | 135/87 X |
| 4,085,762 | 4/1978 | O'Brian et al. | 446/478 X |
| 4,131,227 | 12/1978 | Patton et al. | 446/80 X |
| 4,508,519 | 4/1985 | Becker | 446/478 |
| 4,594,072 | 6/1986 | Cowell | 446/486 X |

FOREIGN PATENT DOCUMENTS

| | | | |
|---|---|---|---|
| 2402503 | 7/1975 | Fed. Rep. of Germany | 135/102 |

*Primary Examiner*—Robert A. Hafer
*Assistant Examiner*—D. Neal Muir
*Attorney, Agent, or Firm*—Woodard, Emhardt, Naughton, Moriarty & McNett

[57] ABSTRACT

This invention consists of a doll playhouse of generally triangular cross-section designed to give the appearance of a small tent. The playhouse has a handle at the apex of the playhouse so that the playhouse may be easily carried when not in use. The playhouse has a hollow interior in which a child can place dolls during fantasy play. The playhouse also has a window in one side wall, covered by a mesh, and comprising a window flap attached at the top edge of the window on the exterior of the tent playhouse. The window flap covers the window in the closed position, while in the open position the window flap is gathered up and tied in place by ribbons also affixed to the tent playhouse. The playhouse has a front opening covered by two triangular flaps extending from the side walls of the playhouse. Each flap is accompanied by two ribbons also affixed to the side walls, which can be used to tie in front of the opening when the flaps are closed to keep the flaps closed and to restrain the contents of the tent playhouse. The ribbons can also be used to hold the flaps in an open position when the flaps are gathered up to expose the front opening.

8 Claims, 1 Drawing Sheet

MULTI-USE DOLL PLAYHOUSE

BACKGROUND OF THE INVENTION

Field of the Invention

This invention relates to a multi-use doll playhouse, whereby the playhouse can be used in play as an activity center for the dolls, or it can be used to store and transport the dolls within.

Summary of the Invention

This invention consists of a doll playhouse of generally triangular cross-section designed to give the appearance of a small tent. The playhouse has a handle at the apex of the playhouse so that the playhouse may be easily carried when not in use. The playhouse has a hollow interior in which a child can place dolls during fantasy play. The playhouse also has a window in one side wall, covered by a mesh, and comprising a window flap attached at the top edge of the window on the exterior of the tent playhouse. The window flap covers the window in the closed position, while in the open position the window flap is gathered up and tied in place by ribbons also affixed to the tent playhouse. The playhouse has a front opening covered by two triangular flaps extending from the side walls of the playhouse. Each flap is accompanied by two ribbons also affixed to the side walls, which can be used to tie in front of the opening when the flaps are closed to keep the flaps closed and to restrain the contents of the tent playhouse. The ribbons can also be used to hold the flaps in an open position when the flaps are gathered up to expose the front opening.

DESCRIPTION OF THE PREFERRED EMBODIMENT

Figure 1:
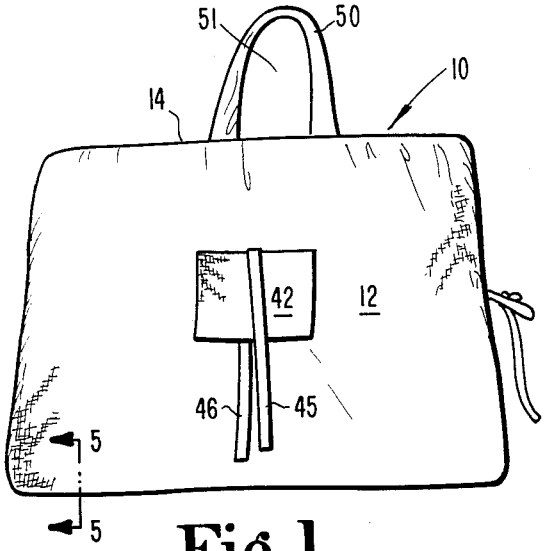
FIG. 1 is a side elevational view of a multi-use doll playhouse shown with the side window flap and front opening flaps in the closed position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In a preferred embodiment, the present invention comprises a body 10 having a bottom wall 11, a left side wall 12 and a right side wall 13. The left and right side walls, respectively, are attached at a bottom edge to opposite edges of the bottom wall. The top edges of the left and right side walls, respectively, are attached to form the apex 14 of the body. A triangular back wall 15 is attached at its perimeter to the back edges of the bottom wall, the left wall and the right wall to form a prismatic volume with an opening at the front end.

Figure 3:
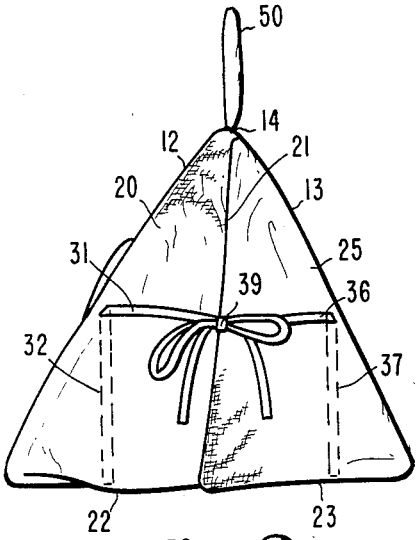
FIG. 3 is a front elevational view of the playhouse shown with the side window flap and the front opening flaps in the closed position.

The front opening is loosely covered by a left triangular flap 20 and a right triangular flap 25. Each flap is attached at its hypotenuse to the front edge of the left and right side walls, respectively. In the normally closed position, as shown in FIG. 3, the vertical edges of each flap loosely abut at 21 in the vertical plane of the apex 14, while the horizontal edges 22 and 23, respectively, loosely abut the front edge of the bottom wall 11.

Figure 4:
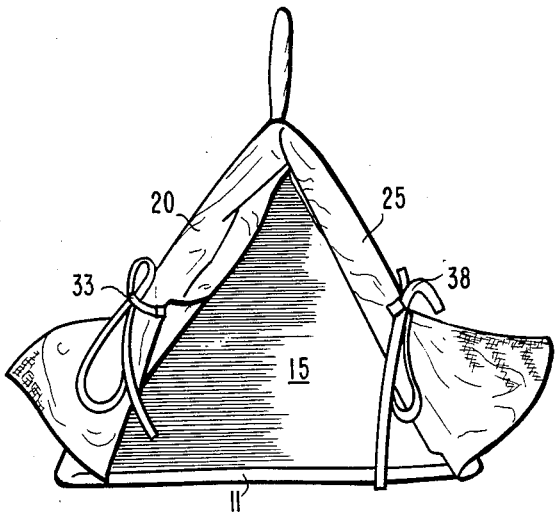
FIG. 4 is a front elevational view of the playhouse shown with the front opening flaps in the open position.

In the open configuration, as shown in FIG. 4, each flap is rolled or gathered upon itself from the vertical edge of the flap toward the front edge of the left and right side walls, respectively. The left flap is held in the open position by a left exterior ribbon 31 and a left interior ribbon 32, the interior ribbon being shown in dash lines in FIG. 3. When the left flap 20 is rolled up, the left exterior and interior ribbons 31 and 32, respectively, are tied together at 33 to hold the flap in position. Similarly, the right flap 25 is held in position by a right exterior ribbon 36 and a right interior ribbon 37 tied together at 38. When the left and right flaps are in the closed configuration, the left and right exterior ribbons can be tied at 39 to hold the flaps closed and to restrain the contents of the playhouse. The ribbons 31 and 32 are attached to the left side wall at generally the same location and near the front edge of the left side wall. The ribbons 36 and 37 are attached to the right side wall at generally the same location and near the front edge of the right side wall.

Figure 2:
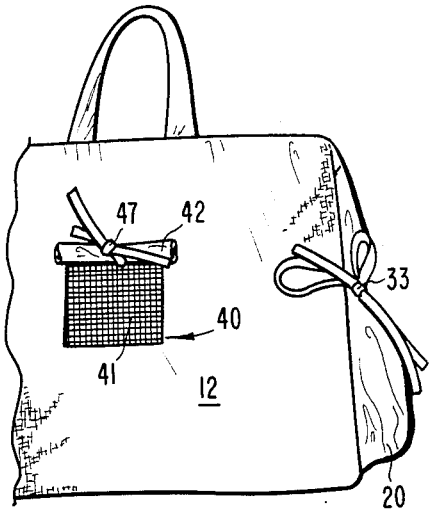
FIG. 2 is an elevational view similar to FIG. 1, but with portions broken away and showing the side window flap and a front opening flap in the open position.

A window 40 is located in one side wall, shown in the left side wall 12 in FIG. 2. An open mesh 41 is attached at its perimeter to the side wall at the window opening. A window flap 42 is attached to the side wall at the upper side of the window 40 and covers the window in a closed position. In the open position, the window flap 42 is rolled or gathered upon itself from the bottom edge toward the top edge. The window flap is held in the open position by an exterior ribbon 45 and an interior ribbon 46, tied together at 47. The exterior ribbon is attached to the side wall 12 at the top side of the window and, when not tied, hangs outside the flap 42. The interior ribbon is attached to the side wall at the top side of the window and, when not tied, hangs between the window mesh 41 and the inner surface of the flap 42.

A handle 50 is attached at the apex 14 of the playhouse, and is located generally at the center of the body so that the playhouse may be carried in a substantially horizontal orientation. The handle 50 is a U-shaped loop, forming an opening 51 large enough for a hand to fit into the opening and grasp the handle.

Figure 5:
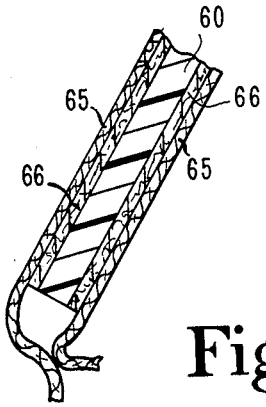
FIG. 5 is an enlarged cross-sectional view of a portion of the playhouse taken at Section 5—5 in FIG. 1.

The bottom wall 11, and the left and right side walls 12 and 13, respectively, are constructed as shown in FIG. 5. A rigid core 60 is formed to the rectangular basic shape of each of the walls. The material of the core 60 has sufficient flexural rigidity to allow the playhouse to hold its normal shape when assembled, and may be, for example, a foam plastic covered on it surface by a solid plastic. The material is also sufficiently resilient to allow the playhouse to elastically deform without fracturing when subjected to an external load, and to permit the playhouse to return to its normal shape when the external load is removed. One example of a suitable materials is known by the trademark KOMAPOR and has a thickness of approximately $\frac{1}{4}''$.

In one specific embodiment, the walls 11, 12, and 13 have a width and height of $13\frac{3}{4}''$ by $11\frac{1}{2}''$. The core 60 is sandwiched between two layers of an outer covering 65. The material of the outer covering 65 is durable and washable, such as nylon. The back wall, window flap, and left and right triangular flaps are made of a single layer of nylon and do not have a core construction.

The relative rigidity of the core 60 is softened by quilt batting 66 between the core 60 and the material 66. The material 65 in the specific embodiment is rip stop nylon which is a material frequently used for making camping tents and is available, for example, from JoAnn Fabrics in Indianapolis, Indiana. The open mesh 41 is available also from retail fabric stores and is generally used and known as "plastic canvas", its normal use being needle point canvas.

In one embodiment the free edges of the nylon outer covering 6 are sewn to the free edges of the opposing nylon covering 65, with a layer of quilt batting 66, the core 60, and another layer of quilt batting 66 sandwiched between the two covering pieces. The top edges of the left and right side walls 12 and 13, respectively, are sewn together at the apex. The back wall 15, the left and right triangular flaps 20 and 25, respectively, the window flap 42 and the handle 50 are sewn to the body 10 at their respective attachment locations. The left and right exterior ribbons 31 and 36, respectively, the left and right interior ribbons 32 and 37, respectively, and the window flap exterior and interior ribbons 45 and 46, respectively, are also sewn to the body 10 at their respective attachment points.

This multi-use playhouse is normally used by a child in fantasy play. The playhouse has the appearance of a tent, complete with the usual features of a tent. The tent-playhouse in the specific embodiment is ten (10) inches high from the bottom wall to the apex, fifteen (15) inches long from the back wall to the front opening, and twelve (12) inches wide across the front opening at the bottom wall. The dimensions of this playhouse render it adequate for use with several small dolls. The playhouse is also small and lightweight so that a child can easily hand-carry the playhouse using the integral handle. Once play is through, the child can store dolls and other small toys in the interior of the tent-playhouse, close the left and right front flaps, and tie the left and right exterior ribbons across the opening to keep the flaps closed and the contents inside. Also, in such a closed condition, the tent-playhouse can be used as a carrying case for transporting the dolls and other contents of the tent-playhouse from place to place.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A multi-use doll playhouse comprising:

a body of generally triangular cross-section with an opening at a front end, having a bottom wall and a left and right side wall, each of generally rectangular shape, said side walls being attached to the bottom wall at opposite edges of the bottom wall, and said side walls being joined at the top edge of each side wall to form an apex, said body further having a back wall of triangular shape attached at its perimeter to the bottom wall and to each side wall;

said apex having a central portion;

a flexible handle affixed to said body at the central portion of said apex;

flap means arranged to cover said opening at one end of the body when in a closed position and movable to an open position substantially exposing said opening;

at least one of said side walls having window means therein, said window means having an open and a closed position;

said flap means including:

a left triangular flap having a hypotenuse and affixed at its hypotenuse to the front edge of the left side wall;

a right triangular flap having a hypotenuse and affixed at its hypotenuse to the front edge of the right side wall;

each of said triangular flaps having a second edge which, when the flaps are in the closed position, is vertical and loosely abuts the second edge of the other flap;

each of said triangular flaps having a third edge which, when the flaps are in closed position, is horizontal and loosely abuts the front edge of said bottom wall, to substantially close the front opening in the playhouse;

a left tie-down arrangement including a left exterior ribbon attached near the front edge of the outer surface of the left side wall, and a left interior ribbon attached near the front edge of the inner surface of the left side wall in generally the same location as said left exterior ribbon, each of said exterior and interior ribbons having sufficient length to be tied around and restrain said left triangular flap when said flap is gathered upon itself toward the left wall;

a right tie-down arrangement including a right exterior ribbon attached near the front edge of the outer surface of the right side wall, and a right interior ribbon attached near the front edge of the inner surface of the right side wall in generally the same location as said right exterior ribbon, each of said right exterior and right exterior ribbons having sufficient length to be tied around and restrain said right triangular flap when gathered upon itself toward the right wall; and each of said left exterior and right exterior ribbons having sufficient length to extend horizontally across the front opening of the playhouse, and to be tied together in front of the opening when the flap means is in the closed position;

each of said bottom wall, left side wall, and right side wall including a resilient core with quilt batting on both sides of said core with an outer covering to cover each of said quilt batting.

2. The multi-use playhouse of claim 1, wherein said window means comprises:

an aperture extending through one of said side walls, said aperture having a perimeter and a top edge;

a mesh attached to said one side wall at the perimeter of said aperture and covering said aperture;

a window flap attached to said one side wall at the top edge of the perimeter of the aperture, said window flap substantially covering the aperture when in the closed position;

said one side wall having an outer surface; and a window tie-down arrangement comprising an exterior ribbon attached to the outer surface of the one side wall near the top edge of the perimeter of the aperture, and an interior ribbon attached at the top edge of the perimeter of the aperture in generally the same location as the exterior ribbon and located between said window flap and said mesh, each of said exterior and interior ribbons having sufficient length to be tied around and restrain the window flap when said flap is gathered upon itself toward the top edge of the perimeter of the aperture.

3. The multi-use playhouse of claim 2, wherein each of said bottom wall, left side wall and right side wall comprises:

a core piece formed of a material having adequate flexural rigidity so that the playhouse will retain its normal configuration when assembled, while having sufficient resilience to permit the playhouse to elastically deform when subject to an external load and to return to its normal configuration when the load is removed;

an outer covering enclosing said core piece and formed of a durable and washable material.

4. The multi-use playhouse of claim 3 wherein said flexible handle comprises a substantially U-shaped loop, attached at each end of the loop to said apex and forming an opening of sufficient size to permit hand access into the loop to grasp the handle.

5. The multi-use playhouse of claim 4, wherein each of said back wall, window flap, left triangular flap, and right triangular flap are of a durable and washable material.

6. A multi-use doll playhouse comprising:

a body of generally triangular cross-section with an opening at a front end, having a bottom wall and a left and right side wall, each of generally rectangular shape, said side walls being attached to the bottom wall at opposite edges of the bottom wall, and said side walls being joined at the top edge of each side wall to form an apex, said body further having a back wall of triangular shape attached at its perimeter to the bottom wall and to each side wall;

said apex having a central portion;

a flexible handle affixed to said body at the central portion of said apex;

flap means arranged to cover said opening at one end of the body when in a closed position and movable to an open position substantially exposing said opening;

at least one of said side walls having window means therein, said window means having an open and a closed position;

said window means including:

an aperture extending through said one side wall, said aperture having a perimeter and a top edge;

a mesh attached to said one side wall at the perimeter of said aperture and covering said aperture;

a window flap attached to said one side wall at the top edge of the perimeter of the aperture, said window flap substantially covering the aperture when in the closed position;

said one side wall having an outer surface; and a window tie-down arrangement comprising an exterior ribbon attached to the outer surface of the one side wall near the top edge of the perimeter of the aperture, and an interior ribbon attached at the top edge of the perimeter of the aperture in generally the same location as the exterior ribbon and located between said window flap and said mesh, each of said exterior and interior ribbons having sufficient length to be tied around and restrain the window flap when said flap is gathered upon itself toward the top edge of the perimeter of the aperture;

and each of said bottom wall, left side wall, and right side wall including a resilient core with quilt batting on both sides of said core with an outer covering to cover each of said quilt batting.

7. The multi-use playhouse of claim 6, wherein each of said bottom wall, left side wall and right side wall comprises:

a core piece formed of a material having adequate flexural rigidity so that the playhouse will retain its normal configuration when assembled, while having sufficient resilience to permit the playhouse to elastically deform when subject to an external load and to return to its normal configuration when the load is removed;

an outer covering enclosing said core piece and formed of a durable and washable material.

8. A multi-use doll playhouse comprising:

a body of generally triangular cross-section with an opening at a front end, having a bottom wall and a left and right side wall, each of generally rectangular shape, said side walls being attached to the bottom wall at opposite edges of the bottom wall, and said side walls being joined at the top edge of each side wall to form an apex, said body further having a back wall of triangular shape attached at its perimeter to the bottom wall and to each side wall;

said apex having a central portion;

a flexible handle affixed to said body at the central portion of said apex;

flap means arranged to cover said opening at one end of the body when in a closed position and movable to an open position substantially exposing said opening;

at least one of said side walls having window means therein, said window means having an open and a closed position;

each of said bottom wall, left side wall and right side wall including:

a core piece formed of a material having adequate flexural rigidity so that the playhouse will retain its normal configuration when assembled, while having sufficient resilience to permit the playhouse to elastically deform when subject to an external load and to return to its normal configuration when the load is removed;

a quilt batting on both sides of said core piece;

an outer covering enclosing said core piece and associated core battings and formed of a durable and washable material.

* * * * *

UNITED STATES PATENT AND TRADEMARK OFFICE

CERTIFICATE OF CORRECTION

PATENT NO. : 4,743,215

DATED : May 10, 1988

INVENTOR(S) : Mickie C. Emmons

It is certified that error appears in the above-identified patent and that said Letters Patent is hereby corrected as shown below:

At column 3, line 2, the figure "13 3/4" should be stricken and replaced by the figure "13 7/8".

Signed and Sealed this

Twentieth Day of September, 1988

*Attest:*

DONALD J. QUIGG

*Attesting Officer*

*Commissioner of Patents and Trademarks*